US006558525B1

(12) United States Patent
Bradford et al.

(10) Patent No.: US 6,558,525 B1
(45) Date of Patent: May 6, 2003

(54) ANODE FOR USE IN ALUMINUM PRODUCING ELECTROLYTIC CELL

(75) Inventors: Donald R. Bradford, Underwood, WA (US); Robert J. Barnett, Goldendale, WA (US); Michael B. Mezner, Sandy, OR (US)

(73) Assignee: Northwest Aluminum Technologies, Seattle, WA (US)

( * ) Notice: Subject to any disclaimer, the term of this patent is extended or adjusted under 35 U.S.C. 154(b) by 0 days.

(21) Appl. No.: 10/086,255

(22) Filed: Mar. 1, 2002

(51) Int. Cl.[7] ..... C25C 3/08

(52) U.S. Cl. ..... 205/380; 205/372; 205/374; 205/375; 205/376; 205/385; 205/386; 205/394; 205/396; 205/387; 204/243.1; 204/244; 204/245; 204/247.3; 204/247.4; 204/284; 204/280; 204/291; 204/293

(58) Field of Search ..... 205/372, 374, 205/375, 376, 378, 380, 385, 386, 394, 396, 387; 204/243.1, 244, 245, 247.3, 247.4, 284, 293, 280, 291

(56) References Cited

U.S. PATENT DOCUMENTS

| | | | | | |
|---|---|---|---|---|---|
| 3,300,396 | A | | 1/1967 | Walker | 204/49 |
| 3,558,464 | A | | 1/1971 | Danna | 204/219 |
| 3,943,048 | A | | 3/1976 | Fisher et al. | 204/290 |
| 3,957,600 | A | | 5/1976 | Ives et al. | 204/105 |
| 4,049,887 | A | | 9/1977 | Whittingham | 429/112 |
| 4,140,594 | A | * | 2/1979 | Rogers, Jr. et al. | 204/243.1 |
| 4,151,061 | A | * | 4/1979 | Ishikawa et al. | 204/247.3 |
| 4,399,008 | A | | 8/1983 | Ray | 204/67 |
| 4,529,494 | A | | 7/1985 | Joo' et al. | 204/290 |
| 4,620,905 | A | | 11/1986 | Tarcy et al. | 204/64 |
| 4,865,701 | A | | 9/1989 | Beck et al. | 204/67 |
| 4,871,438 | A | | 10/1989 | Marschman et al. | 204/290 |
| 4,956,068 | A | | 9/1990 | Nguyen et al. | 204/242 |
| 4,960,494 | A | | 10/1990 | Nguyen et al. | 204/67 |
| 4,999,097 | A | | 3/1991 | Sadoway | 204/243 |
| 5,006,209 | A | | 4/1991 | Beck et al. | 204/67 |
| 5,069,771 | A | | 12/1991 | Nguyen et al. | 204/292 |
| 5,284,562 | A | | 2/1994 | Beck et al. | 204/243 |
| 5,391,285 | A | | 2/1995 | Lytle et al. | 205/123 |
| 5,415,742 | A | * | 5/1995 | La Camera et al. | 204/245 |
| 5,472,578 | A | * | 12/1995 | De Nora | 204/243.1 |
| 5,532,086 | A | | 7/1996 | Thibault et al. | 429/245 |
| 5,637,239 | A | | 6/1997 | Adamski et al. | 219/69.15 |
| 5,667,649 | A | | 9/1997 | Bushman | 204/290 |
| 5,725,744 | A | | 3/1998 | de Nora et al. | 204/244 |
| 5,993,637 | A | | 11/1999 | Hisamatsu et al. | 205/652 |
| 6,099,711 | A | | 8/2000 | Dahms et al. | 205/101 |
| 6,113,759 | A | | 9/2000 | Uzoh | 204/285 |
| 6,251,251 | B1 | | 6/2001 | Uzoh et al. | 205/99 |

* cited by examiner

*Primary Examiner*—Bruce F. Bell
(74) *Attorney, Agent, or Firm*—Andrew Alexander

(57) ABSTRACT

A method of producing aluminum in an electrolytic cell containing alumina dissolved in an electrolyte, the method comprising the steps of providing a molten salt electrolyte at a temperature of less than 900° C. having alumina dissolved therein in an electrolytic cell having a liner for containing the electrolyte, the liner having a bottom and walls extending upwardly from said bottom. A plurality of non-consumable anodes and cathodes are disposed in a vertical direction in the electrolyte, the cathodes having a plate configuration and the anodes having a flat configuration to compliment the cathodes. The anodes contain apertures therethrough to permit flow of electrolyte through the apertures to provide alumina-enriched electrolyte between the anodes and the cathodes. Electrical current is passed through the anodes and through the electrolyte to the cathodes, depositing aluminum at the cathodes and producing gas at the anodes.

83 Claims, 6 Drawing Sheets

ANODE FOR USE IN ALUMINUM PRODUCING ELECTROLYTIC CELL

BACKGROUND OF THE INVENTION

The government has rights in this invention pursuant to Contract No. DE-FC07-00ID13901 awarded by the Department of Energy.

This invention relates to aluminum and more particularly it relates to an improved anode for use in the electrolytic production of aluminum from alumina dissolved in a molten salt electrolyte.

There is great interest in using an inert anode in an electrolytic cell for the production of aluminum from alumina dissolved in the molten salt electrolyte. By definition, the anode should not be reactive with the molten salt electrolyte or oxygen generated at the anode during operation. Anodes of this general type are either comprised of a cermet or metal alloy. For example, U.S. Pat. No. 4,399,008 discloses a composition suitable for fabricating into an inert electrode for use in the electrolytic production of metal from a metal compound dissolved in a molten salt. The electrode comprises at least two metal oxides combined to provide a combination metal oxide.

Also, U.S. Pat. No. 5,284,562 discloses an oxidation resistant, non-consumable anode for use in the electrolytic reduction of alumina to aluminum, which has a composition comprising copper, nickel and iron. The anode is pail of an electrolytic reduction cell comprising a vessel having an interior lined with metal which has the same composition as the anode. The electrolyte is preferably composed of a eutectic of $AlF_3$ and either (a) NaF or (b) primarily NaF with some of the NaF replaced by an equivalent molar amount of KF or KF and LiF.

Other anodes of this type are disclosed in U.S. Pat. Nos. 3,943,048; 3,957,600; 4,049,887; 4,529,494; 4,620,905; 4,865,701; 4,871,438; 4,956,068; 4,960,494; 4,999,097; 5,006,209; 5,069,771; 5,637,239; 5,667,649; 5,725,744; and 5,993,637.

Anodes used for electrolysis take different forms. For example, U.S. Pat. No. 3,300,396 discloses electroplating techniques and anode assemblies for electroplating wherein the anode pieces are contained in a titanium basket which is permanently destroyed in the plating tank.

U.S. Pat. No. 3,558,464 discloses novel anodes for use in electrolytic cells having generally vertical slots in the lower portion of the anodes which are open at the bottom of the anode and closed at the ends of the slots with a plurality of gas conducting channels connecting the top of the slots with the upper surface of the anode. The cathodes of the cells are the liquid mercury anode type.

U.S. Pat. No. 5,391,285 discloses an adjustable plating cell for uniform bump plating of semiconductor wafers wherein an apparatus plates metal bumps of uniform height on one surface of a semiconductor wafer (32). A plating tank (12) contains the plating solution. The plating solution is filtered (16) and pumped (14) through an inlet (22) to an anode plate (24) within plating cell (20). The anode plate has a solid center area to block direct in-line passage of the plating solution, and concentric rings of openings closer to its perimeter to pass the plating solution.

U.S. Pat. No. 5,532,086 discloses an anode for use in an electrochemical cell comprising a current collector layer having a thickness less than about 10 mils, and desirably less than about 4 mils, and a rigid support extending adjacent one side of the current collector layer so that the current collector layer is sandwiched between the anodic layer of the anode and the rigid support. The rigid support maintains the current collector layer in the original configuration of the current collector layer during discharge and recharge cycles of the cell. A cell containing the anode is also disclosed. The rigid support for the anode current collector can be mounted in the electrochemical cell case so as to allow for the release from the cell of gas produced at the anode.

U.S. Pat. No. 6,099,711 discloses a method for the electrolytic deposition of metal coatings, in particular of copper coatings with certain physical-mechanical and optical properties and uniform coating thickness. According to known methods using soluble anodes and applying direct current, only uneven metal distribution can be attained on complex shaped workpieces. By using a pulse current or pulse voltage method, the problem of the coatings being of varying thickness at various places on the workpiece surfaces can indeed be reduced.

U.S. Pat. No. 6,113,759 discloses an anode assembly includes a perforated anode and an electrical contact assembly attached to the anode. A perforated anode holder holds the anode. The anode holder includes perforations at least in a bottom wall such that plating solution may flow through perforations in the anode holder and perforations in the anode. An anode isolator separates the anode and a cathode. The anode isolator includes at least one curvilinear surface. The contact assembly includes a closed or substantially closed cylinder member of titanium or titanium alloy, a copper lining or disk disposed within the cylinder, and a titanium or titanium alloy post fixed and in electrical engagement with the lining or disk.

U.S. Pat. No. 6,251,251 discloses an anode assembly including a perforated anode. A perforated anode holder holds the anode. The anode holder includes perforations at least in a bottom wall such that plating solution may flow through perforations in the anode holder and perforations in the anode. An anode isolator separates the anode and a cathode. The anode isolator includes at least one curvilinear surface.

In spite of these disclosures, there is still a great need for a process utilizing a low temperature electrolytic cell for the production of aluminum using an improved anode and anode design.

SUMMARY OF THE INVENTION

It is an object of the present invention to provide an improved method for producing aluminum from alumina in an electrolytic cell.

It is another object of the invention to provide an improved method for producing aluminum from alumina in an electrolytic cell employing inert or unconsumable anodes.

It is still another object of the invention to provide an improved method for supplying alumina saturated electrolyte to the active surface of the anode in an electrolytic for producing aluminum.

And, it is another object of the invention to provide an improved method of operating an electrolytic cell employing inert anodes for producing aluminum from alumina by using an improved method of flowing alumina saturated electrolyte to anode surface.

These and other object will become apparent from the specification, claims and drawings appended hereto.

In accordance with these objects, there is provided a method of producing aluminum in an electrolytic cell containing alumina dissolved in an electrolyte, the method comprising the steps of providing a molten salt electrolyte at a temperature of less than 900° C. having alumina dissolved therein in an electrolytic cell having a liner for containing the electrolyte, the liner having a bottom and walls extending upwardly from said bottom. A plurality of non-consumable anodes and cathodes are disposed in a vertical direction in the electrolyte, the cathodes having a plate configuration and the anodes having a flat configuration to compliment the cathodes. The anodes contain apertures therethrough to permit flow of electrolyte through the apertures to provide alumina-enriched electrolyte between the anodes and the cathodes. Electrical current is passed through the anodes and through the electrolyte to the cathodes, depositing aluminum at the cathodes and producing gas at the anodes.

The invention includes an improved anode for use in an electrolytic cell for producing aluminum from alumina dissolved in a molten salt electrolyte contained in the cell. The cell contains at least one cathode and one anode disposed in the electrolyte defining a region between the electrodes, the cathode having a flat surface. The improved anode comprises a substantially flat surface configuration for disposing opposite said cathode surface to provide an anode-cathode distance defining a region between said anode and said cathode surfaces. The anode has apertures to permit flow of electrolyte through the apertures to provide alumina-enriched electrolyte in the region between the anodes and the cathodes.

The invention further includes an electrolytic cell for producing aluminum from alumina dissolved in an electrolyte, the cell comprised of a liner for containing the electrolyte, the liner having a bottom and walls extending upwardly from the bottom. A plurality of non-consumable anodes and cathodes are disposed in the electrolyte contained in the cell. The cathodes have a plate configuration having a cathode surface and the anodes having a first surface and second flat surface disposed from the cathode surface to define a region between the anode and cathode. The anodes contain apertures extending from the first surface to the second flat surface to permit flow of electrolyte therethrough to provide alumina-enriched electrolyte between the anodes and the cathodes. Means are provided for passing electrical current through the anodes and through the electrolyte to the cathodes for producing aluminum at the cathode and gas at the anodes.

Thus, an anode is provided for use in an electrolytic cell for producing aluminum from alumina dissolved in a molten salt electrolyte contained in the cell. The cell contains at least one cathode and one anode disposed in the electrolyte, the cathode having a planar surface. The anode has a substantially flat first surface for disposing opposite the cathode planar surface to provide a controlled anode-cathode distance defining a region between the anode and the cathode surfaces. The anode has a second surface disposed opposite the first surface to provide the anode with a thickness dimension. Apertures extend from the first surface of the anode to the second surface, the apertures defined by a wall of the anode, the wall providing additional anode active surface area during electrolysis of the alumina in the cell.

DETAILED DESCRIPTION OF PREFERRED EMBODIMENTS

The subject invention includes an electrolytic cell for the production of aluminum from alumina dissolved in a molten salt electrolyte. Preferably, the molten electrolyte is maintained at a temperature of less than 900° C. However, electrolytes such as cryolite may be used at higher temperatures, e.g., 925° to 975° C. Further, preferably, the alumina is added to the cell on a continuous basis to ensure a controlled supply of alumina during electrolysis. The electrolytic cell of the invention employs anodes and cathodes. In the process of the invention, electric current is passed from the anode through the molten electrolyte to cathode reducing alumina to aluminum and depositing the aluminum at the cathode. While the cathodes are preferably comprised of titanium diboride, it will be understood that the cathodes can be comprised of any suitable material that is substantially inert to the molten aluminum at operating temperatures. Such materials can include zirconium boride, molybdenum, tungsten, titanium carbide and zirconium carbide.

The anode can be any non-consumable anode selected from cermet or metal alloy anodes substantially inert to electrolyte at operating temperatures. By the use of the terms inert or non-consumable is meant that the anodes are resistant to attack by molten electrolyte and do not react or become consumed in the same manner as carbon anodes in a Hall-Heroult type cell. The cermet is a mixture of metal such as copper and metal oxides or other metal compound. As fabricated, the metal anode is substantially free of metal oxides. A preferred metal, non-consumable anode for use in the cell is comprised of iron, nickel, copper. The metal anode can contain about 1 to 50 wt. % Fe, 15 to 50 wt. % Ni, the remainder comprising copper. A preferred anode consists essentially of 1–30wt. % Fe, 15–60 wt. % Ni, and 25 to 70 wt. % Cu. Typical non-consumable anodes can have compositions in the range of 2 to 17 wt. % Fe, 25 to 48 wt. % Ni and 45 to 70 wt. % Cu.

The electrolytic cell can have an operating temperature less than 900° C. and typically in the range of 660° C. (1220° F.) to about 800° C. (1472° F.). Typically, the cell can employ electrolytes comprised of $NaF+AlF_3$ eutectics, $KF+AlF_3$ eutectic, and LiF. The electrolyte can contain 6 to 26 wt. % NaF, 7 to 33 wt. % KF, 1 to 6 wt. % LiF and 60 to 65 wt. % $AlF_3$. More broadly, the cell can use electrolytes that contain one or more alkali metal fluorides and at least one metal fluoride, e.g., aluminum fluoride, and use a combination of fluorides as long as such baths or electrolytes operate at less than about 900° C. For example, the electrolyte can comprise NaF and $AlF_3$. That is, the bath can comprise 62 to 53 mol. % NaF and 38 to 47 mol. % $AlF_3$.

Figure 1:
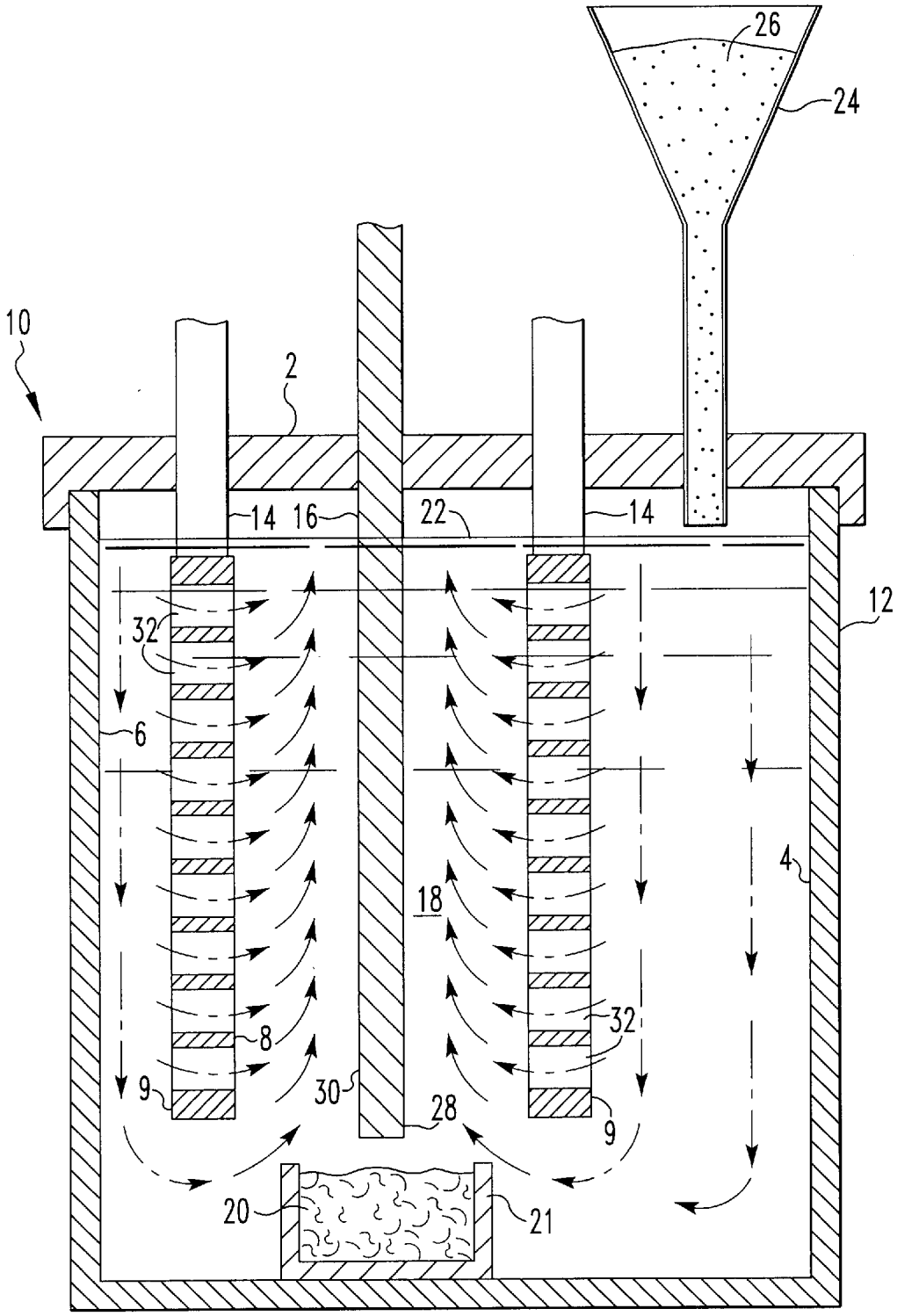
FIG. 1 is a cross-sectional view of a test electrolytic cell employed in testing.
Figure 7:
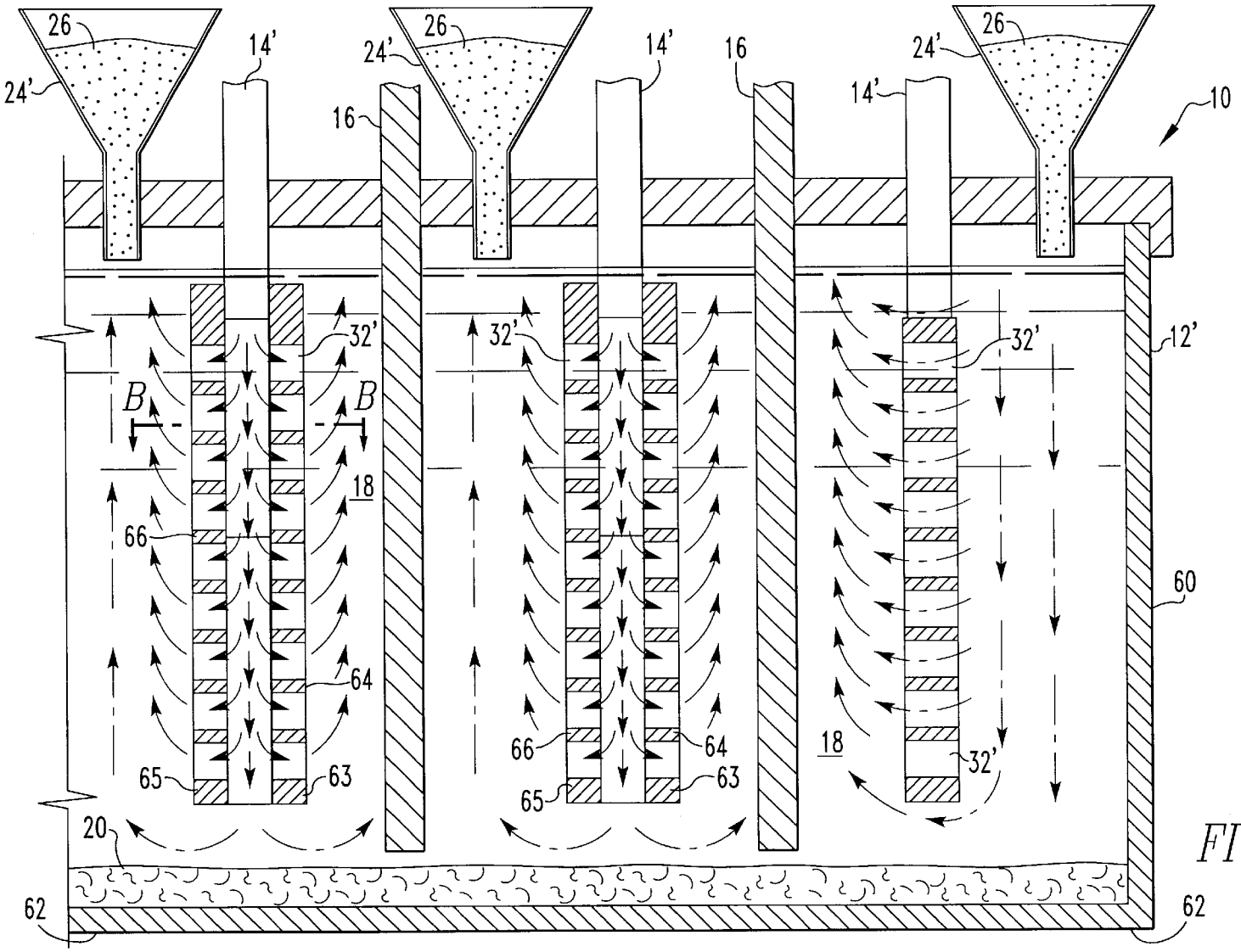
FIG. 7 is a cross section of an electrolytic cell in accordance with the invention.

Referring now to FIG. 1, there is shown a schematic of a laboratory electrolytic cell 10 used for electrolytically reducing alumina to aluminum, in accordance with the invention. Cell 10 is comprised of an alumina or metal crucible 12 containing anodes 14 of the invention and cathode 16. A molten salt electrolyte 18 also is provided in cell 10. Cell 10 is sealed with a cover 2. Anodes 14 and cathode 16 are suspended through lid 2 from a superstructure (not shown) and connected to bus bars above the cell. Anodes 14 and cathode 16 are in the form of vertical plates with an anode on each side of the cathode. The cathode used in the test cell was $TiB_2$ and the anodes were comprised of an Ni-Cu-Fe alloy having 42 wt. % Ni, 30 wt. % Cu, and 28 wt. % Fe. The molten salt electrolyte was comprised of 38.89 wt. % sodium fluoride and 61.11 wt. % aluminum fluoride. For tests, typically the molten electrolyte was maintained below 900° C. and typically in the range of 730° to 800° C. although the temperature can range from 660° to 800° C. for low temperature operation. When the cell is operated, aluminum is deposited at the cathode and collects in a pool 20. If the crucible 12 is comprised of metal, then an insulated reservoir 21 is required to collect molten aluminum 20. If crucible 12 is comprised of refractory, then molten aluminum can collect on the bottom of the cell, as illustrated in FIG. 7.

The present invention has the advantage that it efficiently provides an alumina enriched molten electrolyte to active surface 8 of anodes 14. That is, molten salt electrolyte has certain flow patterns within cell 10 and alumina particles 26 are added to surface 22 of the electrolyte from hopper 24. In the embodiment illustrated in FIG. 1, molten electrolyte is shown flowing in a downward direction adjacent walls 4 and 6 of cell 10 and in an upwardly direction adjacent cathode surfaces 28 and 30. The lift or upward direction movement of the molten electrolyte is caused in part by the evolution of gases such as oxygen gas at the active anode surface.

In the present invention, apertures 32 are provided in anodes 14 to permit flow of alumina-enriched electrolyte to be quickly available at active surfaces 8 of anodes 14. Thus, during operation of cell 10, molten electrolyte flows downwardly adjacent walls 4 and 6 and simultaneously therewith flows through holes or apertures 32 supplying alumina laden or enriched electrolyte to anode active surfaces 8. This has the advantage of minimizing starvation of alumina at the active surface of the anode resulting in greater stability of the anode. That is, in using a conventional anode in cell 10 of FIG. 1, molten electrolyte has to traverse to the bottom or ends of the anode before providing dissolved alumina for reduction. Thus, it will be appreciated gradations of concentrations of alumina can occur with conventional planar anodes and in commercial cells the distance along the surface of the anode can vary significantly, adversely affecting operation of the cell and the integrity of the anodes. That is, at the center, for example, of the anode surface there can be starvation of available alumina, thus subjecting the anode surface to reduction, defeating the inert quality desired.

The apertures provided in anodes 14 have another benefit. That is, depending on the number of apertures and the thickness of the anode, the apertures may contribute to the active surface area of the anode. The ratio of anode active surface to cathode active surface can range from 1:1 to 5:1. It will be understood that the wall of anode material defining apertures 32 can contribute to anode active surface 8. Further it will be seen in FIGS. 1, 2 and 3 that apertures 32 have a cylindrical shape. However, other shapes such as square or oval, for example, are contemplated. Further, apertures 32 can have a fluted or funnel shape. That is, aperture 32 can increase in diameter from one side of the anode to the other, e.g., from the non-active surface to the active surface. The active surface of the anode is the surface opposite the cathode surface and can include the wall defining apertures 32. While only one hopper 24 is shown projecting through lid or cover 2, it will be understood that a number of hoppers can be used to introduce alumina to the melt.

Figure 2:
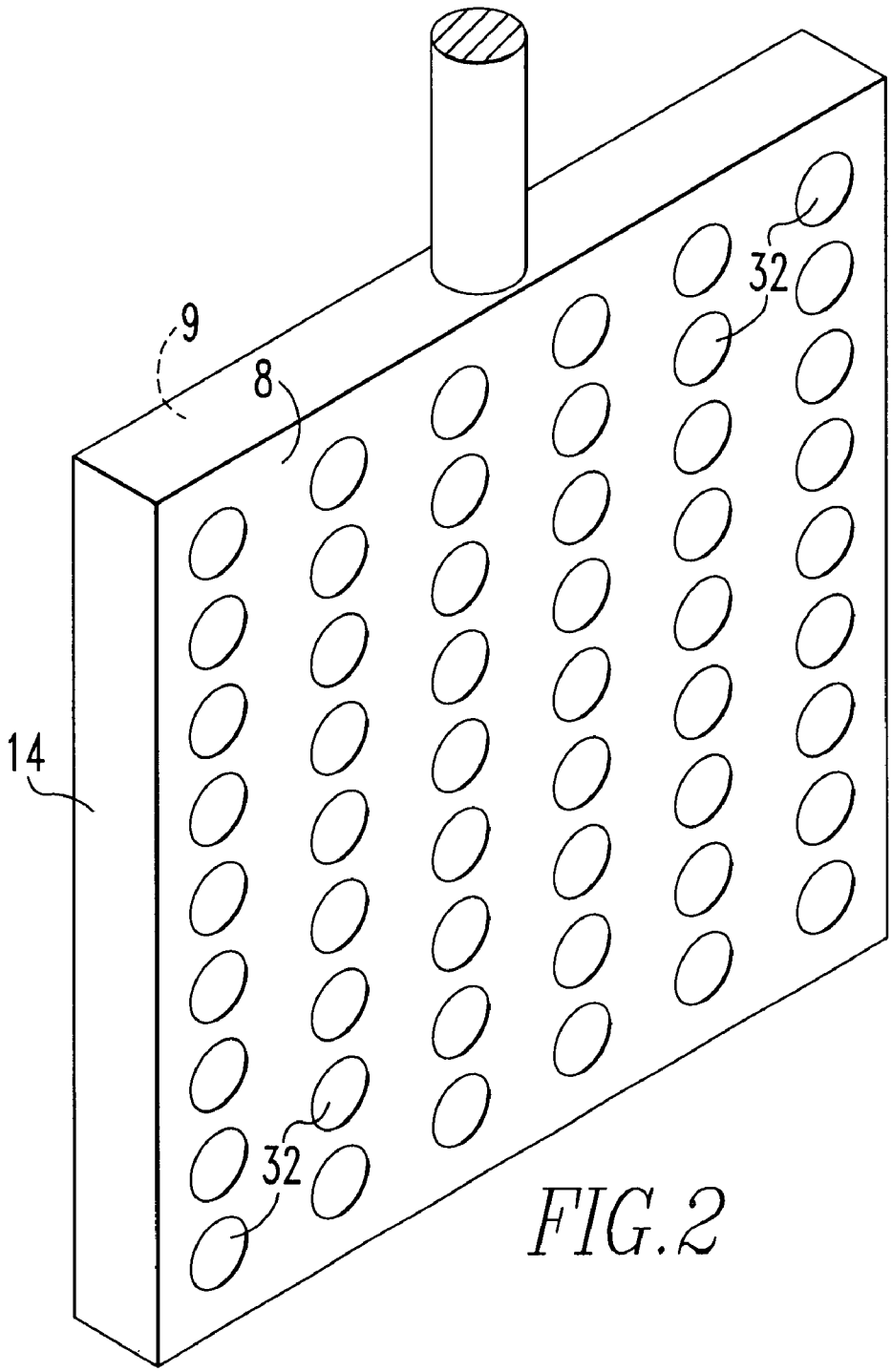
FIG. 2 is a schematic of an anode of the invention.

FIG. 2 is a dimensional view of anode 14 in accordance with the invention, illustrating apertures 32 provided in orderly manner across the thickness of anode 14 from surface 8 to surface 9. The apertures can be formed by any convenient manner such as by casting or drilling. Further, the apertures can have a diameter from about ⅛ inch to about 1 inch, depending on the size of the anode being used.

Figure 3:
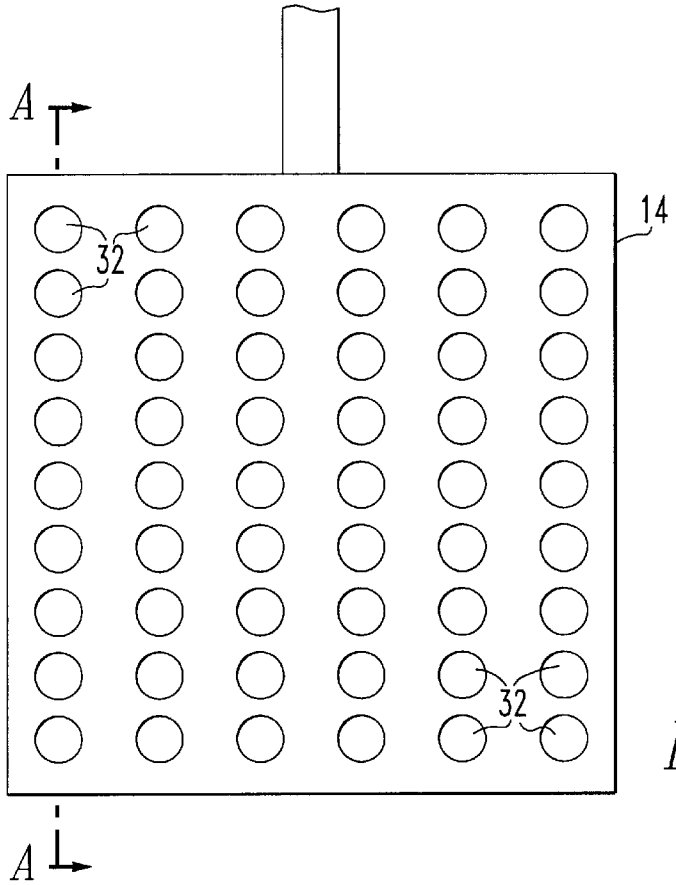
FIG. 3 is another view of the anode of FIG. 2.
Figure 4:
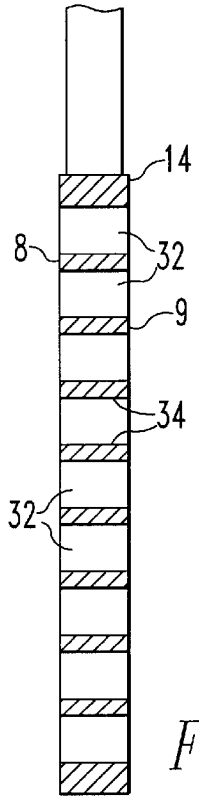
FIG. 4 is a cross-sectional view along the line A—A of FIG. 3.

FIG. 3 is a perspective view of one face or surface of the anode and apertures 32 provided therein. FIG. 4 is a cross-sectional view along the line A—A of FIG. 3, illustrating apertures extending from surface 9 to surface 8 to permit the free flow of alumina-enriched, molten electrolyte through the anode to the active surface which is surface 8 and can include wall 34 defining aperture 32 in FIG. 1.

Alumina useful in the cell can be any alumina that is comprised of finely divided particles. Usually, the alumina has a particle size in the range of about 1 to 100 $\mu$m.

In the present invention, the cell can be operated at a current density in the range of 0.1 to 1.5 A/cm$^2$ while the electrolyte is maintained at a temperature in the range of 660° to 800° C. A preferred current density is in the range of about 0.4 to 1.3 A/cm$^2$. The lower melting point of the bath (compared to the Hall cell bath which is above 950° C.) permits the use of lower cell temperatures, e.g., 730° to 800° C. reduces corrosion of the anodes and cathodes.

The anodes and cathodes in the cell can be spaced to provide an anode-cathode distance in the range of ¼ to 1 inch. That is, the anode-cathode distance is the distance between anode surface 8 and cathode surface 28 or 30.

Further, in a commercial cell thermal insulation can be provided around liner or crucible and on the lid in an amount sufficient to ensure that the cell can be operated without a frozen crust and frozen side walls. However, in certain instances, it may be desirable to permit freezing of bath on the sidewalls to provide for sidewall protection.

Figure 5:
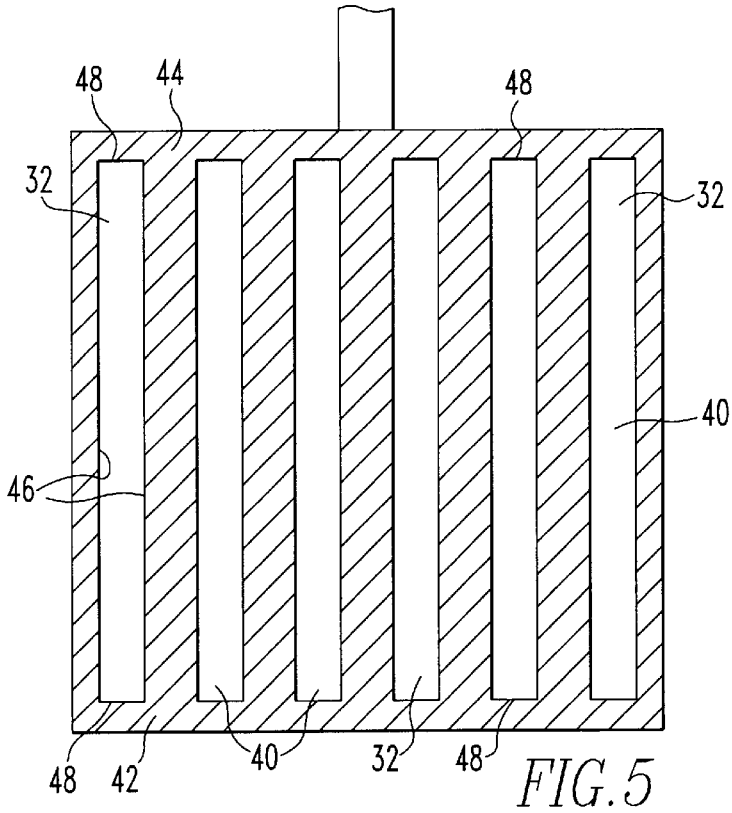
FIG. 5 is a schematic of another embodiment of the invention.

While the anodes of the invention have been described with apertures 32 being provided as cylindrical openings as shown in FIGS. 1, 2 and 3, it is believed that any means or opening that permits or improves the flow of alumina-enriched electrolyte to the region between the cathode surface and anode surface can be used. Thus, for example, an anode of the invention is shown in FIG. 5 wherein apertures 32 may be provided as slots 40 which extend substantially vertically from a bottom wall 42 to a top wall 44. Slots 40 are defined by walls 46 and 48. As noted earlier with respect to apertures 32, slots 40 permit flow of alumina-enriched molten electrolyte to the region between the anode and cathode surfaces and thus efficiently provides alumina at the active surfaces for electrolysis purposes and thus the efficiency of the cell is enhanced, permitting the use of higher current densities.

Figure 6:
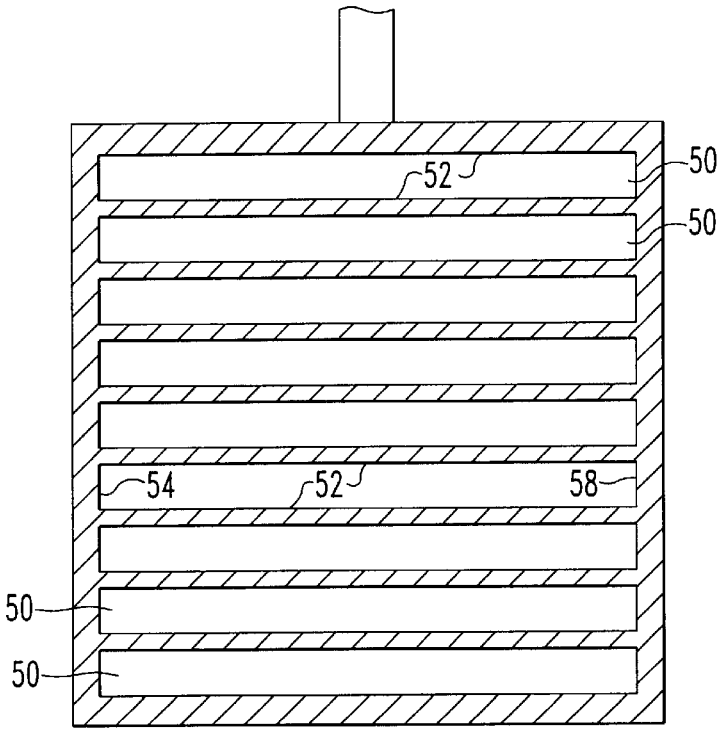
FIG. 6 is schematic of yet another embodiment of the invention.

While the apertures 32 or slots 40 are shown in FIG. 5 extending substantially vertically, it should be understood that apertures 32 can take the form of horizontal slots 50 as shown in FIG. 6. Thus, the apertures may be provided as horizontal slots 50 defined by walls 52 and 54. As noted earlier, slots 50 permit flow of alumina enriched molten electrolyte to the region between the anode and cathode active surfaces for purposes of electrolysis. Thus, as aluminum ions are removed from the electrolyte and deposited at the cathode as aluminum metal, the apertures immediately provide a supply of alumina-enriched electrolyte for electrolysis. Further, the active surface of anode is increased by the wall defining the slot depending on the thickness of the anode, as explained earlier with respect to circular shaped apertures. It should be noted that in FIGS. 5 and 6, the slots do not have to extend fully from top to bottom or from side to side as shown but may be comprised of a series of short slots which may be formed randomly in the anode to complement flow of alumina-enriched electrolyte between the active surface of the anode and cathode. It will be appreciated that different size apertures can be used in an anode whether they are slots or circles. Further, it will be appreciated that the invention includes utilizing apertures in an anode which provides the shortest distance for alumina-enriched electrolyte to the region between the active surfaces of the anode and the cathode.

Figure 10:
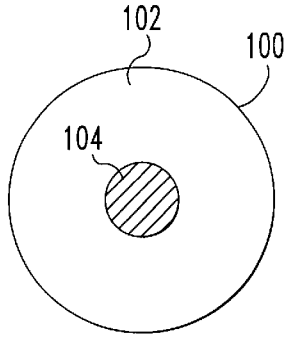
FIG. 10 is a cross-sectional view illustrating a cylindrical cell having a central cathode surrounded by a cylindrical anode.

While the anode and cathode surfaces have been depicted as being flat, such surfaces can be curved or corrugated. One surface or both surfaces can be curved or corrugated preferably to provide a uniform distance between anode and cathode active surface. For example, the anode can take the form of a cylinder 100, FIG. 10, with the appropriate apertures provided therein to flow electrolyte into the region 102 between cathode 104 which is illustrated in the form of a post.

When multiple anodes and cathodes are used as in a commercial cell, an improved design of anode can be used having active faces which are continuously supplied with alumina-enriched electrolyte. In FIG. 7, there is illustrated an improved electrolytic cell 10' having multiple anodes 14' and cathodes 16'. Multiple hoppers 24' can be used to feed alumina 26 on a continuous basis to electrolyte 18 wherein the alumina is efficiently digested in the molten electrolyte. The cell can be comprised of a metal shell 12' having sides 60 and bottom 62. When the shell is not active, i.e., anodic, the outside or end anode can have the configuration shown in FIG. 1 for anodes and also illustrated in FIG. 7 as 14'. Cathodes 16' can also have the same configuration as illustrated in FIG. 1 and shown in FIG. 7 as 16. Also, as illustrated in FIGS. 1 and 7, the cathode can be longer than anode 14 and 14' extending towards molten aluminum 20. However, cathode 16 can be sufficiently short in order to avoid contacting molten aluminum 20. In such design, current is removed from the cathode above lid 2, for example. However, cathode 16 can be designed to remove current through bus (not shown) at the bottom of the cell. Further, cathode 16 can be mounted or positioned in the bottom of the cell and current removed through bottom bus.

In accordance with the invention shown in FIG. 7, anode 14' is designed as a hollow anode in order to provide two active surfaces 64 and 66. Hollow anodes 14' are provided with apertures 32' to facilitate flow of alumina-enriched molten electrolyte to the region of the cell between active surfaces of anode 14' and cathode 16. As illustrated in FIG. 7, electrolyte flow is in an upward direction between anode- and cathode-active surfaces and in a generally down direction in side hollow anode 14'. In FIG. 7, as molten electrolyte flows downwardly in hollow anode 14' electrolyte escapes into the region between anode and cathode active surface to provide or add alumina-enriched electrolyte as it is depleted during electrolysis. It will be appreciated that apertures may be sized from top to bottom to facilitate flow therethrough as desired during electrolysis.

Figure 8:
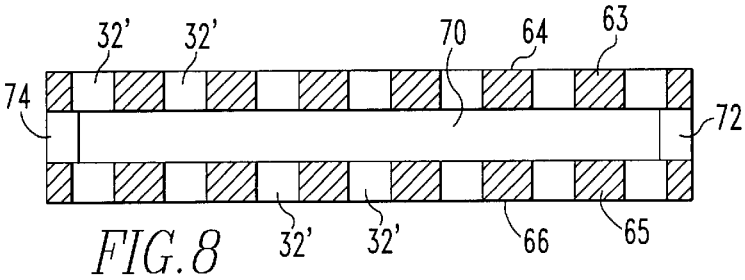
FIG. 8 is a cross-sectional view of an anode in FIG. 7 along the line B—B.

A cross section of hollow anode 14' along the line B—B in FIG. 7 is shown in FIG. 8. Cross section illustrated in FIG. 8 shows apertures 32' for flowing alumina-enriched electrolyte from inside or hollow 70 to the region between the anode-active surface and the cathode-active surface. Hollow 70 is defined by sides 63 and ends 72 and 74. It will be appreciated that ends 72 and 74 may be eliminated and spacers (not shown) used to maintain hollow 70.

Figure 9:
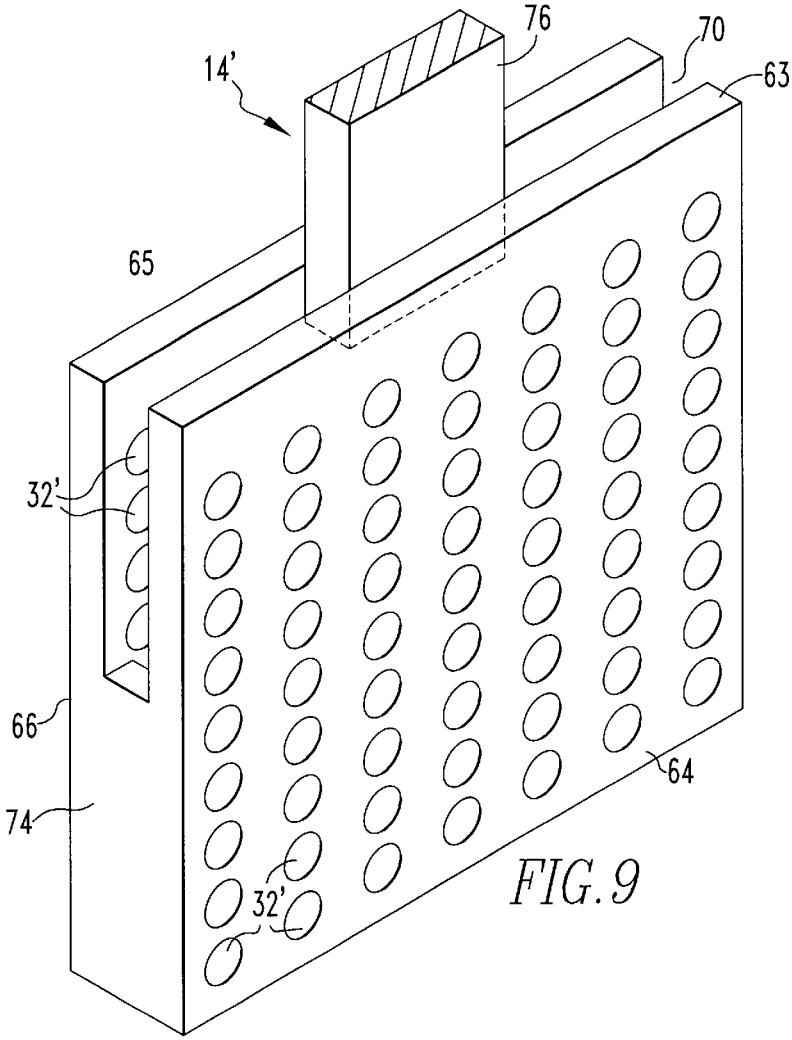
FIG. 9 is a perspective view of the anode used in FIG. 7.

FIG. 9 is a dimensional view of hollow anode 14' showing stub 76 which may be used for supporting anode plates 63 and 65 in cell 10'. Anode 14', as shown in FIG. 9, is comprised of plates 63 and 65 which are separated sufficiently to permit location of stub 76 therebetween for purposes of supporting the anode of the cell. It will be seen that plates 63 and 65 are provided with apertures or holes 32' which, as noted, permit flow of electrolyte from hollow 70 or inside anode 14' to active surfaces 64 and 66. In the embodiment of anode 14', sides 74 and 72 may be provided to contain electrolyte and force flow of electrolyte through apertures 32'. Further, from the description of FIG. 7 it will be noted that molten electrolyte enters at the top or opening between plates 63 and 65 and flows downwardly and outwardly through apertures 32'.

The following examples are still further illustrative of the invention.

EXAMPLE 1

This invention was tested in a 200A cell having the configuration shown in FIG. 1 with alumina added to the cell substantially continuously. The cell comprised an alumina ceramic container. Within the ceramic container was placed a vertical cathode suspended through the lid of the container and connected to a bus bar. On either side of the cathode, two anodes were positioned or suspended through the lid and connected to bus bar. The anodes were 4 inches by 4 inches by 0.25 inch thick. Each anode was drilled to provide 112 holes 0.25 inch in diameter. The anodes were comprised of 42 wt. % Cu, 30 wt. % Ni and 28 wt. % Fe, and the cathode was $TiB_2$. The cell contained a molten salt bath comprised of 38.89 wt. % sodium fluoride and 61.11 wt. % aluminum fluoride. The top of the cell was sealed with an insulating lid and the cell was maintained at an operating temperature of 770° –780° C. which was above the melting point of the salt bath and the aluminum metal. The alumina fed to the cell had a particle size of about 100 $\mu$m or less and was effectively ingested by the circulation of the bath in the cell during operation. The cell was operated at a current density of up to 1 amp/cm$^2$ for a period of 100 hours. Aluminum deposited at the cathode drained downwardly to the bottom of the cell and was removed periodically. Oxygen gas evolved at the active face of the anode provided a generally upward movement of the bath in the regions between the anodes and the cathode. The bath had a generally downward movement between the anode and the wall of the container. Oxygen was removed from the cell through feed tube of the alumina. The apertures provided in the anodes permitted alumina-rich electrolyte to more effectively reach the active regions of the electrodes without the need to travel to the bottom of the anode and then to the surface of the electrolyte to get replenished. That is, the improved anodes permitted a more effective method for feeding alumina-enriched electrode to the active region between anode and the cathode and for replenishing the electrolyte with alumina. The anodes were used for about 100 hours without any appearance of blistering or significant corrosion.

Having described the presently preferred embodiments, it is to be understood that the invention may be otherwise embodied within the scope of the appended claims.

What is claimed is:

1. A method of producing aluminum in an electrolytic cell containing alumina dissolved in an electrolyte, the method comprising the steps of:

(a) providing a molten salt electrolyte at a temperature of less than 900° C. having alumina dissolved therein in an electrolytic cell having a liner for containing the electrolyte, said liner having a bottom and walls extending upwardly from said bottom;

(b) providing a plurality of substantially non-consumable anodes and cathodes disposed in a generally vertical direction in said electrolyte, said cathodes having a surface, said anodes having a surface disposed opposite said surface of said cathode defining a region therebetween, said anodes containing apertures through said surface of said anode to permit flow of electrolyte through said apertures to provide alumina-enriched electrolyte to said region between said anodes and said cathodes; and (c) passing electrical current through said anodes and through said electrolyte to said cathodes for purposes of electrolysis, depositing aluminum at said cathodes and producing gas at said anodes.

2. The method in accordance with claim 1 wherein said surfaces of said cathode and said anode are planar surfaces.

3. The method in accordance with claim 1 wherein said electrolyte is comprised of one or more alkali metal fluorides.

4. The method in accordance with claim 1 wherein said electrolyte is comprised of one or more alkali metal fluorides and aluminum fluoride.

5. The method in accordance with claim 1 including maintaining said electrolyte in a temperature range of about 660° to 800° C.

6. The method in accordance with claim 1 wherein said electrolyte has a melting point in the range of 715° to 800° C.

7. The method in accordance with claim 1 including passing an electric current through said cell at a current density in the range of 0.1 to 1.5 A/cm$^2$.

8. The method in accordance with claim 1 including maintaining said liner as an anode by passing electric current therethrough.

9. The method in accordance with claim 8 wherein said anodes are comprised of a NiCuFe-containing alloy.

10. The method in accordance with claim 1 wherein said anodes are selected from the group consisting of cermets and metal alloys.

11. The method in accordance with claim 10, wherein said cathodes are selected from the group consisting of titanium diboride, zirconium diboride, titanium carbide, zirconium carbide and molybdenum.

12. The method in accordance with claim 1 wherein said anodes are comprised of metal alloys.

13. The method in accordance with claim 1 wherein said anodes and cathodes have planar surfaces arranged in a vertical orientation in said electrolyte and wherein said anodes and cathodes are arranged in alternating relationship.

14. The method in accordance with claim 1 including adding alumina to said cell on a substantially continuous basis.

15. The method in accordance with claim 1 wherein said anode is a cermet anode.

16. The method in accordance with claim 1 including collecting aluminum from said cathode in the bottom of said cell.

17. The method in accordance with claim 1 wherein said anodes are hollow and have two planar surfaces, each planar surface disposed opposite a surface of said cathode, permitting flow of alumina-enriched electrolyte from said hollow through said apertures to the region between said anodes and said cathodes.

18. The method in accordance with claim 1 wherein said flow of molten electrolyte in said cell is generally in an upwardly direction between said anodes and said cathodes.

19. The method in accordance with claim 1 including maintaining alumina in said electrolyte in a range of 2 to 6 wt. %.

20. A method of producing aluminum in an electrolytic cell containing alumina dissolved in an electrolyte, the method comprising the steps of:

(a) providing a molten salt electrolyte having a melting point in the range of 715° to 800° C. and having alumina dissolved therein in an electrolytic cell having a liner for containing the electrolyte, said liner having a bottom and walls extending upwardly from said bottom;

(b) providing a plurality of anodes and cathodes disposed in a generally vertical direction in said electrolyte, said cathodes having a planar surface disposed opposite an anode planar surface, said cathodes' and said anodes' planar surfaces defining a region therebetween, said anodes comprised of a material selected from the group consisting of cermet and metal alloy, said anodes containing apertures through said anode planar surface to permit flow of electrolyte through said apertures to provide alumina-enriched electrolyte to said region between said anodes and said cathodes; and (c) passing electrical current through said anodes and through said electrolyte to said cathodes, depositing aluminum at said cathodes and producing gas at said anodes.

21. The method in accordance with claim 20 wherein said electrolyte is comprised of one or more alkali metal fluorides.

22. The method in accordance with claim 20 wherein said electrolyte is comprised of one or more alkali metal fluorides and aluminum fluoride.

23. The method in accordance with claim 20 wherein said electrolyte has a melting point in the range of 715° to 800° C.

24. The method in accordance with claim 20 including maintaining said liner as an anode by passing electric current therethrough.

25. The method in accordance with claim 24, wherein said anodes are comprised of a NiCuFe-containing alloy.

26. The method in accordance with claim 20 including passing an electric current through said cell at a current density in the range of 0.1 to 1.5 A/cm$^2$.

27. The method in accordance with claim 20 wherein said anodes are comprised of metal alloys.

28. The method in accordance with claim 20 wherein said anodes and cathodes have planar surfaces arranged in a vertical orientation in said electrolyte and wherein said anodes and cathodes are arranged in alternating relationship.

29. The method in accordance with claim 20 including adding alumina to said cell on a substantially continuous basis.

30. The method in accordance with claim 20 wherein said anode is a cermet anode.

31. A method of producing aluminum in an electrolytic cell containing alumina dissolved in an electrolyte, the method comprising the steps of:

(a) providing a molten salt electrolyte having alumina dissolved therein in an electrolytic cell having a liner for containing the electrolyte, said liner having a bottom and walls extending upwardly from said bottom;

(b) adding alumina to said electrolyte on a continuous basis to provide an alumina-enriched electrolyte;

(c) providing a plurality of substantially non-consumable anodes and cathodes disposed in a generally vertical direction in said electrolyte, said cathodes having a surface and said anodes having a planar surface disposed opposite said surface of said cathode defining a region therebetween, said anodes containing apertures through said planar surface;

(d) flowing alumina-enriched electrolyte through said apertures to provide alumina-enriched electrolyte to said region between said anodes and said cathodes; and (e) passing electrical current through said anodes and through said electrolyte to said cathodes, depositing aluminum at said cathodes and producing gas at said anodes.

32. The method in accordance with claim 31 including maintaining alumina in said electrolyte at not greater than 1.0 wt. % above saturation.

33. The method in accordance with claim 32 wherein said flow of molten electrolyte in said cell is generally in an upwardly direction in the region between said cathodes and said anodes.

34. The method in accordance with claim 32 wherein said electrolyte is comprised of one or more alkali metal fluorides.

35. The method in accordance with claim 32 wherein said electrolyte is comprised of one or more alkali metal fluorides and aluminum fluoride.

36. The method in accordance with claim 32 including maintaining said electrolyte in a temperature range of about 660° to 800° C.

37. The method in accordance with claim 32 wherein said electrolyte has a melting point in the range of 715° to 800° C. and an alumina solubility limit in the range of about 3.2 to 5 wt. %.

38. The method in accordance with claim 32 including passing an electric current through said cell at a current density in the range of 0.1 to 1.5 $A/cm^2$.

39. The method in accordance with claim 32 including maintaining said liner as an anode by passing electric current therethrough.

40. The method in accordance with claim 32 wherein said anodes are comprised of a NiCuFe-containing alloy.

41. The method in accordance with claim 32 wherein said cathodes are selected from the group consisting of titanium diboride, zirconium diboride, titanium carbide, zirconium carbide, molybdenum and tungsten.

42. The method in accordance with claim 32 including providing planer anodes and cathodes in a vertical orientation in said electrolyte and arranging said anodes and cathodes in alternating relationship.

43. The method in accordance with claim 32 including adding said alumina at a rate sufficient to maintain alumina at least at saturation in the molten electrolyte.

44. The method in accordance with claim 32 including collecting aluminum from said cathode in a reservoir in the bottom of said cell.

45. An improved anode for use in an electrolytic cell for producing aluminum from alumina dissolved in a molten salt electrolyte contained in said cell wherein aluminum is deposited at the cathode, oxygen is produced at the anode when electric current is passed through the cell, said cell containing at least one cathode and one anode disposed in said electrolyte, said cathode having a surface, said improved anode having a surface for disposing opposite said cathode surface to provide an anode-cathode distance defining a region between said anode and said cathode surfaces, said anode having apertures therein to permit flow of electrolyte through said apertures to provide alumina-enriched molten salt electrolyte in said region between said anodes and said cathodes.

46. The anode in accordance with claim 45 wherein said cathode and said anode have planar surfaces disposed opposite each other.

47. The anode in accordance with claim 45 wherein said anode is a non-consumable anode.

48. The anode in accordance with claim 45 wherein said anode is comprised of a material selected from the group consisting of cermet and metal alloy.

49. The anode in accordance with claim 45 wherein said anode is comprised of Ni—Cu—Fe-containing alloy.

50. The anode in accordance with claim 45 wherein said anode contains a hollow region for flowing alumina-enriched molten electrolyte to said apertures to flow electrolyte through said apertures to said region.

51. An improved anode for use in an electrolytic cell for producing aluminum from alumina dissolved in a molten salt electrolyte contained in said cell, said cell containing at least one cathode and one anode disposed in said electrolyte, said cathode having a flat surface, said improved anode comprising:

two anode panels in electrical communication and separated to define a space between said panels for flowing molten electrolyte, each of said anode panels having a flat surface for disposing opposite said cathode surface to provide a region between the anode and the cathode surface, said panels having apertures to permit flow of alumina-enriched electrolyte contained in said space to said region between said anodes and said cathodes.

52. The anode in accordance with claim 51 wherein said anode is a non-consumable anode.

53. The anode in accordance with claim 51 wherein said anode is comprised of a material selected from the group consisting of cermet and metal alloy.

54. The anode in accordance with claim 51 wherein said anode is comprised of Ni—Cu—Fe-containing alloy.

55. In an improved method of producing aluminum in an electrolytic cell containing alumina dissolved in an electrolyte wherein a molten salt electrolyte is maintained at a temperature of less than 900° C., the electrolyte having alumina dissolved therein, and alumina add to the electrolyte on a continuous basis to provide alumina-enriched electrolyte, and wherein a plurality of non-consumable anodes and cathodes are disposed in a vertical direction in said electrolyte, said cathodes having a flat surface, the improved method comprising:

(a) providing anodes having a planar surface disposed opposite the flat surface of the cathode to define a region between the cathode flat surface and the planar surface of the anode, the anode planar surface containing apertures permitting flow of electrolyte through the apertures to provide alumina-enriched electrolyte to the region between said anodes and said cathodes;

(b) passing electrical current through said anodes and through said electrolyte to said cathodes, depositing aluminum at said cathodes and producing gas at said anodes.

56. The method in accordance with claim 55 wherein said electrolyte is comprised of one or more alkali metal fluorides.

57. The method in accordance with claim 55 wherein said electrolyte is comprised of one or more alkali metal fluorides and aluminum fluoride.

58. The method in accordance with claim 55 including maintaining said electrolyte in a temperature range of about 660° to 800° C.

59. The method in accordance with claim 55 wherein said electrolyte has a melting point in the range of 715° to 800° C.

60. The method in accordance with claim 55 including passing an electric current through said cell at a current density in the range of 0.1 to 1.5 A/cm$^2$.

61. The method in accordance with claim 55 including maintaining said liner as an anode by passing electric current therethrough.

62. The method in accordance with claim or 61 wherein said anodes are comprised of a NiCuFe-containing alloy.

63. The method in accordance with claim 55 wherein said anodes are selected from the group consisting of cermets and metal alloys.

64. The method in accordance with claim 63 wherein said cathodes are selected from the group consisting of titanium diboride, zirconium diboride, titanium carbide, zirconium carbide, molybdenum and tungsten.

65. The method in accordance with claim 55 wherein said anodes are comprised of metal alloys.

66. An electrolytic cell for producing aluminum from alumina dissolved in an electrolyte, the cell comprised of:

(a) a liner for containing the electrolyte, the liner having a bottom and walls extending upwardly from said bottom and means for adding alumina to said cell to provide alumina-enriched electrolyte;

(b) a plurality of non-consumable anodes and cathodes disposed in said electrolyte contained in said cell, said cathodes having a cathode surface, said anodes having an anode surface disposed from said cathode surface to define a region between said anode and cathode, and said anode surface containing apertures extending through said anode surface to permit flow of electrolyte therethrough to provide alumina-enriched electrolyte to said region between said anodes and said cathodes; and (c) means for passing electrical current through said anodes and through said electrolyte to said cathodes for producing aluminum at said cathode and gas at said anodes.

67. The cell in accordance with claim 66 wherein said cathode surface is a planar surface.

68. The cell in accordance with claim 66 wherein said anode surface is a planar surface.

69. The cell in accordance with claim 66 wherein said anode and said cathode have an active area ratio anode to cathode in the range of 1.1:1 to 5:1.

70. The cell in accordance with claim 66 wherein the anodes are comprised of material selected from the group consisting of cermets and metal alloys.

71. The cell in accordance with claim 66 wherein the anodes are comprised of Ni—Cu—Fe alloy.

72. The cell in accordance with claim 66 wherein the cathodes are selected from the group consisting of titanium diboride, zirconium diboride, titanium carbide, zirconium carbide, molybdenum and tungsten.

73. The cell in accordance with claim 66 wherein the anodes and cathodes have planar surfaces arranged in a vertical orientation in said electrolyte and wherein said anodes and cathodes are arranged in alternating relationship.

74. The cell in accordance with claim 66 wherein the anodes are hollow and have two planar surfaces, each planar surface disposed opposite a surface of said cathode, permitting flow of alumina-enriched electrolyte from said hollow through said apertures to the region between said anodes and said cathodes.

75. The cell in accordance with claim 66 wherein said cell is arranged to permit flow of molten electrolyte in said cell is generally in an upwardly direction between said anodes and said cathodes.

76. An anode having increased anode active surface area for use in an electrolytic cell for producing aluminum from alumina dissolved in a molten salt electrolyte contained in the cell, the cell containing at least one cathode and one anode disposed in said electrolyte, said cathode having a surface, the anode having a first surface for disposing opposite said cathode surface to provide a controlled anode-cathode distance defining a region between said anode and said cathode surfaces, said anode having a second surface disposed from said first surface of said anode to provide said anode with a thickness dimension, said anode having apertures extending from said first surface to said second surface, said apertures defined by a wall of said anode, said wall providing additional anode active surface area during electrolysis of said alumina in said cell.

77. The anode in accordance with claim 76 wherein said anode surface is a planar surface.

78. The anode in accordance with claim 76 wherein said first surface of said anode is a planar surface.

79. The anode in accordance with claim 76 wherein the anodes are comprised of material selected from the group consisting of cermets and metal alloys.

80. The anode in accordance with claim 76 wherein the anodes are comprised of Ni—Cu—Fe alloy.

81. The anode in accordance with claim 76 wherein the cathodes are selected from the group consisting of titanium diboride, zirconium diboride, titanium carbide, zirconium carbide, molybdenum and tungsten.

82. The anode in accordance with claim 76 wherein said cell is arranged to permit flow of molten electrolyte in said cell is generally in an upwardly direction between said anodes and said cathodes.

83. An anode having increased anode active surface area for use in an electrolytic cell for producing aluminum from alumina dissolved in a molten salt electrolyte contained in the cell, the cell containing at least one cathode and one anode disposed in said electrolyte, said cathode having a planar surface, the anode having a planar first surface for disposing opposite said cathode planar surface to provide a controlled anode-cathode distance of ¼ to 1 inch defining a region between said anode and said cathode surfaces, said anode having a second surface disposed from said first surface to provide said anode with a thickness dimension, said anode having apertures extending from said first surface to said second surface, said apertures defined by a wall of said anode, said wall providing additional anode active surface area during electrolysis of said alumina in said cell and providing for flow of alumina-enriched electrolyte to said region between said anode and cathode, said anode comprised of a material selected from the group consisting of cermets and metal alloys, the ratio of said anode active surface area to cathode active surface area being in the range of 1:1 to 5:1.

* * * * *